US008136629B2

(12) United States Patent
Inoue et al.

(10) Patent No.: US 8,136,629 B2
(45) Date of Patent: Mar. 20, 2012

(54) SILENCER/MUFFLER

(75) Inventors: Yusuke Inoue, Saitama (JP); Satoshi Matsushima, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/971,487

(22) Filed: Dec. 17, 2010

(65) Prior Publication Data

US 2011/0147118 A1 Jun. 23, 2011

(30) Foreign Application Priority Data

Dec. 21, 2009 (JP) ..... 2009-289132

(51) Int. Cl.
*F01N 1/10* (2006.01)

(52) U.S. Cl. ..... 181/252; 181/268; 181/275; 181/212; 181/228; 181/227

(58) Field of Classification Search ..... 181/212, 181/269, 252, 228, 247, 257, 251, 256
See application file for complete search history.

(56) References Cited

U.S. PATENT DOCUMENTS

| | | | | |
|---|---|---|---|---|
| 3,263,772 | A * | 8/1966 | Irwin et al. | 181/227 |
| 4,252,212 | A * | 2/1981 | Meier | 181/248 |
| 4,834,214 | A * | 5/1989 | Feuling | 181/249 |
| 5,173,576 | A * | 12/1992 | Feuling | 181/247 |
| 5,912,441 | A * | 6/1999 | Worner | 181/282 |
| 7,743,883 | B2 * | 6/2010 | Kondo et al. | 181/244 |
| 2006/0283661 | A1 * | 12/2006 | Tanaka et al. | 181/269 |
| 2007/0289809 | A1 * | 12/2007 | Kim | 181/227 |

FOREIGN PATENT DOCUMENTS

| | | | |
|---|---|---|---|
| JP | 08100627 | * | 4/1996 |
| JP | 2007-56714 | A | 3/2007 |

* cited by examiner

*Primary Examiner* — Forrest M Phillips
(74) *Attorney, Agent, or Firm* — Birch, Stewart, Kolasch & Birch, LLP

(57) ABSTRACT

In a muffler which includes an outer tube which configures an outer wall, an inner tube provided in the outer tube and having punching holes formed therein, and a sound absorbing material filled between the outer tube and the inner tube, and which is attached to an exhaust pipe for exhausting exhaust gas from an engine, the number of punching holes at portions of the inner tube which have a great length to the outer tube is set greater than the number of punching holes at portions of the inner tube which have a small length to the outer tube in comparison with the portions having the great length.

20 Claims, 8 Drawing Sheets

SILENCER/MUFFLER

CROSS-REFERENCE TO RELATED APPLICATIONS

The present application claims priority under 35 USC 119 to Japanese Patent Application No. 2009-289132 filed on Dec. 21, 2009 the entire contents of which are hereby incorporated by reference.

BACKGROUND OF TUE INVENTION

1. Field of the Invention

This invention relates to a muffler for use with a vehicle such as a motorcycle.

2. Description of Background Art

Conventionally, a muffler is attached to an exhaust pipe connected to an engine. In some mufflers of this type, an inner tube having small holes (hereinafter referred to as punching holes) is provided in an outer tube which defines an outer wall, and a sound absorbing material such as glass wool is filled between the outer tube and the inner tube. See, for example, Japanese Patent Laid-Open No. 2007-56714. In such a muffler as just described, a sound pressure of exhaust gas blown out from the punching holes formed in the inner tube is absorbed by the sound absorbing material to achieve sound deadening.

In addition, in the muffler disclosed in Japanese Patent Laid-Open No. 2007-56714, while the punching holes are formed in a similar formation density over the overall inner tube, since the length from an outer circumferential face of the inner tube to an inner circumferential face of the outer tube is not fixed, also the thickness of the filled up sound absorbing material is not fixed. Therefore, non-uniformity occurs with the sound deadening effect by the sound absorbing material such that the sound deadening effect at a thin portion of the sound absorbing material sometimes becomes lower than that at a thick portion of the sound absorbing material, resulting in deterioration of the sound deadening effect. Therefore, it seems possible idea to form the outer tube greater in size than the inner tube in order to assure the thickness of the sound absorbing material. However, in this instance, the muffler becomes too large. Thus, the idea cannot be regarded as a good idea if the actual situation of the demand for reduction in size and weight of a vehicle is taken into consideration.

SUMMARY AND OBJECTS OF THE INVENTION

According to an embodiment of the present invention, a muffler is provided which can achieve a reduction in size together with an improvement with respect to the sound deadening effect.

According to an embodiment of the present invention, a muffler which includes an outer tube 2 which configures an outer wall, an inner tube 3 provided in the outer tube and having punching holes P formed therein with a sound absorbing material 4 filled between the outer tube and the inner tube. The muffler is attached to an exhaust pipe EX for exhausting exhaust gas from an engine wherein the number of punching holes at a portion (for example, at any of flattened face portions 13 and 14 in the embodiment) of the inner tube which has a great length to the outer tube is set greater than the number of punching holes at another portion (for example, at any of side end portions 15 and 16 in the embodiment) of the inner tube which has a small length to the outer tube in comparison with the portion having the great length.

According to an embodiment of the present invention, the muffler includes an inner tube that is formed in a flattened shape and the punching holes are formed in a flattened face portion (for example, in any of the flattened face portions 13 and 14 in the embodiment) of the inner tube, and the inner tube is disposed in the outer tube such that a linear direction of a straight line which interconnects the portion which has the greatest length to the outer tube and the outer tube and a direction of a plane of the flattened face portion may be substantially perpendicular to each other.

According to an embodiment of the present invention, the muffler includes a rectification portion (for example, any of rectification portions 19 and 20 in the embodiment) formed on an inner face of the flattened face portion of the inner tube in such a manner so as to project inwardly.

According to an embodiment of the present invention, the muffler includes a recess (for example, any of recesses 17 and 18 in the embodiment) formed on the flattened face portion of the inner tube, and the rectification portion is formed from the recess.

According to an embodiment of the present invention, the muffler includes the rectification portion which is formed one for each of opposing inner faces of the flattened face portion such that the rectification portions oppose to each other and are displaced to one side from the center in the widthwise direction of the flattened face portion.

According to an embodiment of the present invention, the muffler includes the rectification portion that is formed one for each of opposing inner faces of the flattened face portion such that the rectification portions oppose to each other and besides are formed substantially at the center in the widthwise direction of the flattened face portion.

According to an embodiment of the present invention, the muffler includes a thickness (for example, any of the thicknesses T1 and T2 in the embodiment) between the flattened face portions partitioned by the rectification portions is different from that at the other portion.

According to an embodiment of the present invention, the muffler includes an inner tube that is formed in such a manner so as to have a sectional area which decreases toward an exit side of the exhaust gas.

According to an embodiment of the present invention, the muffler includes an inner tube that has a two-piece structure formed by fixing two members having a parting plane at edge portions (for example, at the side edge portions 15 and 16 in the embodiment) of the flattened face portions, and the punching holes are not formed on the edge portion side of the flattened face portions.

According to an embodiment of the present invention, the muffler includes a sound absorbing material that is a single sheet-like member, and is provided in such a manner so as to be bent at one end portion (for example, at the side end portion 15 in the embodiment) of the flattened face portion and then folded back on the flattened face portion.

According to an embodiment of the present invention, the muffler includes an inner tube that has a flattened sectional shape and is formed in a peanut shape wherein a first main flow path (for example, a path 21 in the embodiment) provided at one end of the elongation side and a second main flow path (for example, a path 22 in the embodiment) provided on the other end of the long side are connected to each other through a reduced diameter portion 23.

According to an embodiment of the present invention, since the sound pressure can be greatly extracted from the portion at which the length from the inner tube to the outer tube is great and the thickness of the sound absorbing material can be assured without the necessity to change the magnitude of the outer tube to assure the thickness of the sound absorbing material, miniaturization can be achieved together with an improvement in the sound deadening effect.

According to an embodiment of the present invention, the surface area of the portion in which the punching holes are formed can be assured, and since the punching holes are directed to the portion of the sound absorbing material which has a greater thickness, the sound deadening effect can be further improved.

According to an embodiment of the present invention, since exhaust gas passing through the inner tube can be dispersed in the widthwise direction in the inside of the inner tube, the internal pressure can be uniformized. Further, where the rectification portion is formed from the recess, since an integrated shape is obtained, the wall thickness of the inner tube can be reduced thereby to achieve a reduction in the weight.

According to an embodiment of the present invention, since the exhaust path in the inside of the inner tube is branched by the rectification portion and the rectification portion is displaced, the exhaust gas flow rate to each of the exhaust paths can be adjusted.

According to an embodiment of the present invention, the exhaust path in the inside of the inner tube is branched by the rectification portion, and the exhaust gas flow rate to the branched exhaust paths can be made uniform.

According to an embodiment of the present invention, the exhaust gas flow can be adjusted.

According to an embodiment of the present invention, since the exhaust path is gradually narrowed to provide airflow resistance, the sound pressure is not extracted immediately to the exit side but can be extracted to the sound deadening material side. Therefore, the sound deadening effect can be further raised.

According to an embodiment of the present invention, a structure which can be produced readily and allows the sound pressure to be extracted to the thick portion of the sound absorbing material can be obtained.

According to an embodiment of the present invention, the inner tube can be covered efficiently with the sound absorbing material such that the thickness of the flattened face portion at which the sound pressure is extracted increases.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
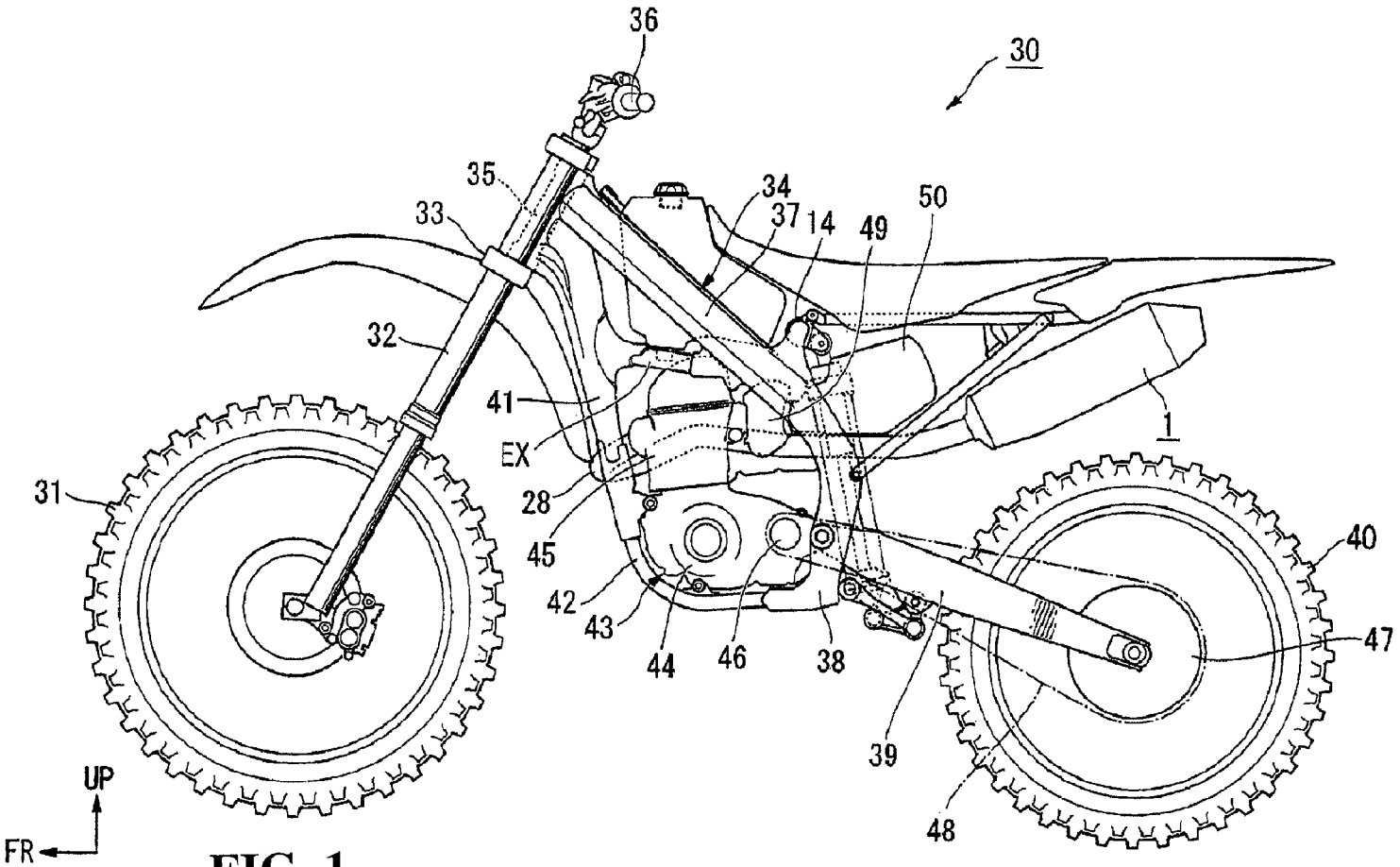
FIG. 1 is a side elevational view of a motorcycle which includes a muffler according to an embodiment of the present invention.

In the following, an embodiment of the present invention is described with reference to the drawings. A side elevational view of an entire motorcycle 30 which includes a muffler 1 according to the embodiment of the present invention is shown in FIG. 1. In the drawings, an arrow mark FR indicating a forward direction of the vehicle and another arrow mark UP indicating an upper direction of the vehicle are shown at suitable locations.

In the motorcycle 30 of an off road type shown in FIG. 1, a front wheel 31 is supported for rotation at a lower end portion of left and right front forks 32, and the left and right front forks 32 are supported at an upper portion thereof for steering movement on a head pipe 35 of a vehicle body frame 34 through a steering stem 33. A steering handle member 36 of the bar type is attached to an upper portion of the steering stem 33.

Left and right main tubes 37 extend rearwardly downwards from the rear side of an upper portion of the head pipe 35 and are connected at a rear end portion thereof to an upper end portion of left and right pivot frames 38 at an intermediate location in the forward and backward direction of the vehicle body. A swing arm 39 is supported at a front end portion thereof for upward and downward rocking motion at a lower portion of the left and right pivot frames 38, and a rear wheel 40 is supported for rotation at a rear end portion of the swing arm 39.

From the rear side of a lower portion of the head pipe 35, a single down frame 41 extends obliquely rearwardly downwards in a gradient steeper than that of the left and right main tubes 37, and from a lower end portion of the down frame 41, left and right lower frames 42 are branched and extend leftwardly and rightwardly in a similar gradient. The left and right lower frames 42 are curved at a lower portion thereof and extend rearwardly until they are connected to a lower end portion of the left and right pivot frames 38.

An engine 43 which is a prime mover of the motorcycle 30 is carried on the inner side of the vehicle body frame 34. The engine 43 is a single cylinder engine having a crankshaft parallel to the vehicle widthwise direction, and a cylinder 45 is provided uprightly substantially vertically on a crankcase 44 which configures a lower portion of the engine 43. A rear portion of the crankcase 44 serves also as a transmission case, and a driving sprocket wheel 46 is disposed on the left side of a rear portion of the crankcase 44. A drive chain 48 extends between and around the driving sprocket wheel 46 and a driven sprocket wheel 47 on the left side of the rear wheel 40.

A throttle body 49 of an engine intake system is connected to a rear portion of the cylinder 45, and an air cleaner case 50 is connected to a rear portion of the throttle body 49. An exhaust pipe EX of an engine exhaust system is connected to a front end portion of the cylinder 45.

The exhaust pipe EX is laid along the right side of the vehicle body and extends to the left side of a rear portion of the vehicle body, and the muffler 1 according to the present invention is connected to a rear end portion of the exhaust pipe EX.

Figure 2:
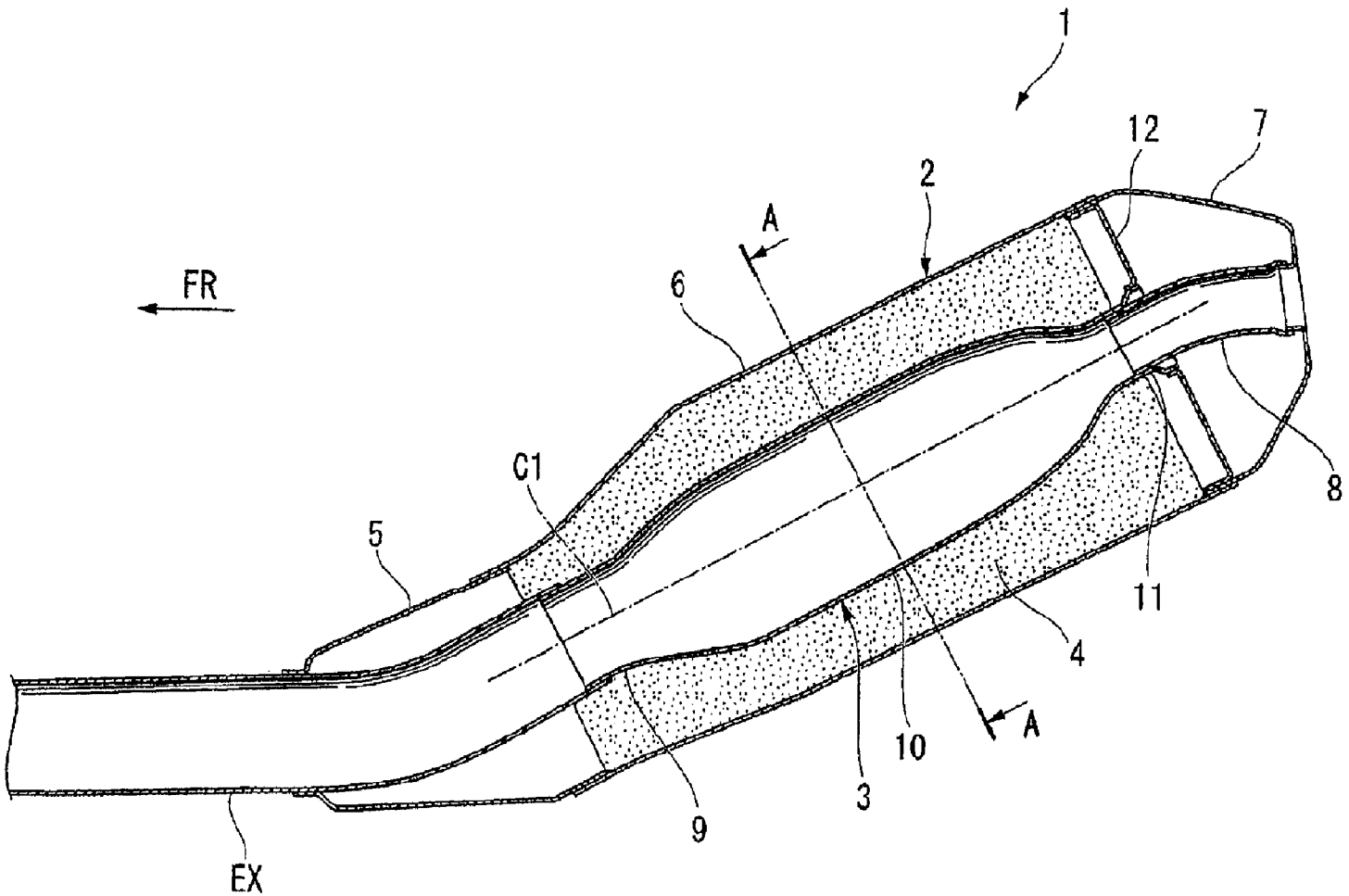
FIG. 2 is a sectional view showing the muffler according to the embodiment of the present invention.

FIG. 2 shows a section of the muffler 1. As shown in the FIG. 2, the muffler 1 includes an outer tube 2 which configures an outer wall, an inner tube 3 provided in the outer tube 2, and a sound absorbing material 4 formed from glass wool filled between the outer tube 2 and the inner tube 3. The muffler 1 is attached to the exhaust pipe EX. In the following, the muffler 1 is described.

In the muffler 1, the outer tube 2 is configured from a front cap member 5, an outer tube body 6, and a rear cap member 7, and the exhaust pipe EX fitted in the muffler 1 is covered at a rear end portion thereof with the front cap member 5 while the inner tube 3 is covered with the outer tube body 6. Further, a tail pipe 8 provided at a rear portion of the inner tube 3 is covered with the rear cap member 7.

The front cap member 5 is formed in a cup shape whose diameter decreases forwardly and contacts at an inner circumferential face of a front portion thereof, which has the reduced diameter, with an outer circumferential face of the exhaust pipe EX. Further, the front cap member 5 is connected at a rear portion thereof, which has the large diameter, to a front portion of the outer tube body 6. The outer tube body 6 is an elongated tubular member extending rearwardly from the front cap member 5 and is connected at a rear portion thereof to the rear cap member 7.

The rear cap member 7 is formed in a cup shape whose diameter decreases rearwardly from a rear portion of the outer tube body 6, and an opening which allows the tail pipe 8 extending from the inner tube 3 to be exposed to the outside is formed at a rear portion of the rear cap member 7. The front cap member 5 and the outer tube body 6, and the outer tube body 6 and the rear cap member 7, are partly overlapped with each other and joined together by rivets.

The inner tube 3 is a tubular member of a two-piece structure formed from two members secured to each other by welding and integrally has a cylindrical front connecting portion 9 connecting to a rear end portion of the exhaust pipe EX, an elongated inner tube body 10 extending rearwardly from a rear portion of the front connecting portion 9, and a cylindrical rear connecting portion 11 formed at a rear portion of the inner tube body 10 and connecting to a front end portion of the tail pipe 8.

In the inner tube 3, the inner tube body 10 is fitted with the inner side of the exhaust pipe EX, and the rear connecting portion 11 is fitted with a front end portion of the tail pipe 8. In FIG. 2, a center line C1 interconnects the centers of the front connecting portion 9 and the rear connecting portion 11. In addition, axial directions of the front connecting portion 9 and the rear connecting portion 11 have an aligned relationship with each other. The inner tube 3 sends exhaust gas from the exhaust pipe EX to the tail pipe 8. The tail pipe 8 discharges the exhaust gas to the outside. The inner tube body 10 has a plurality of small holes (punching holes), whose details are hereinafter described, formed therein so that the exhaust gas is discharged through the holes.

Figure 3:
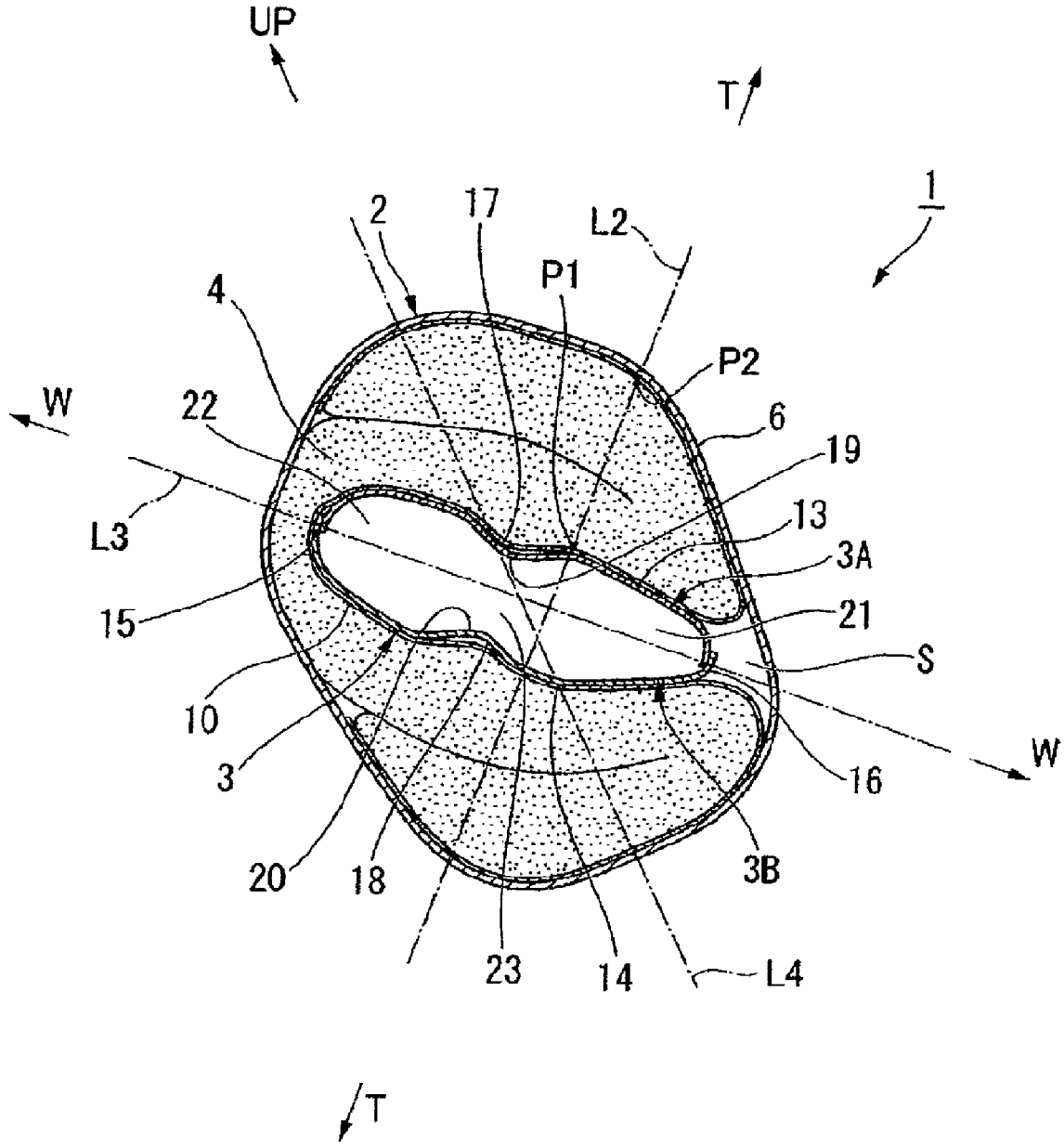
FIG. 3 is a sectional view taken along line A-A of FIG. 2.

Further, in the inner tube 3, the rear connecting portion 11 is fitted in an opening formed in a partition plate 12 which partitions the outer tube body 6 and the rear cap member 7 from each other, and the rear connecting portion 11 contacts at an outer circumferential face thereof with an edge portion of the opening. The partition plate 12 is joined at an outer peripheral edge thereof to the outer tube body 6 and the rear cap member 7 by rivets. Consequently, the inner tube 3 is held in a fixed posture in the outer tube 2 as shown in FIG. 3. In FIG. 3, an inner tube half 3A is provided which configures one-side half of the inner tube 3 with an inner tube half 3B which configures the other side half.

Figure 4:
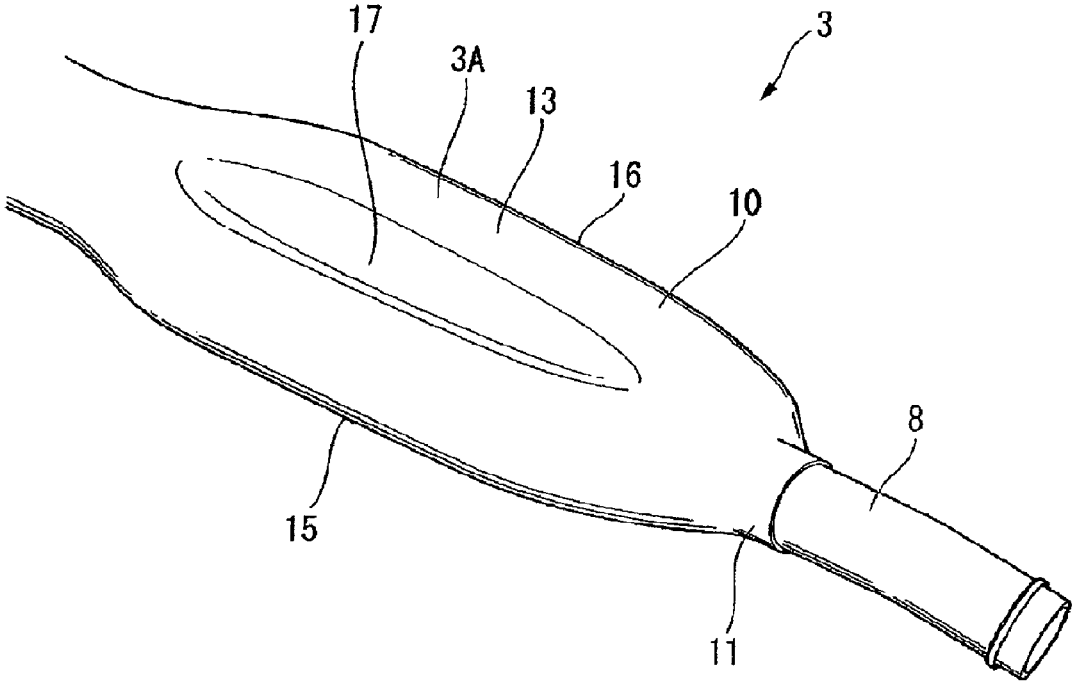
FIG. 4 is a perspective view of an inner tube of a flattened shape which configures the muffler.

In the inner tube 3, the inner tube body 10 is formed in a flattened shape. More particularly, referring also to FIGS. 4 to 6, the inner tube body 10 is formed in a flattened shape such that a closed cross section is configured from a pair of opposing flattened face portions 13 and 14 configuring a wide face and extending in an elongated form in the forward and backward direction with side end portions 15 and 16 which couple the opposite end portions of the flattened face portions 13 and 14 to each other and having a small thickness. In the following, it is assumed that the direction indicated by an arrow mark W shown in FIGS. 3 and 5 indicates the widthwise direction of the inner tube body 10, and the direction of an arrow mark T shown in FIGS. 3 and 6 indicates the thicknesswise direction of the inner tube body 10.

Figure 6:
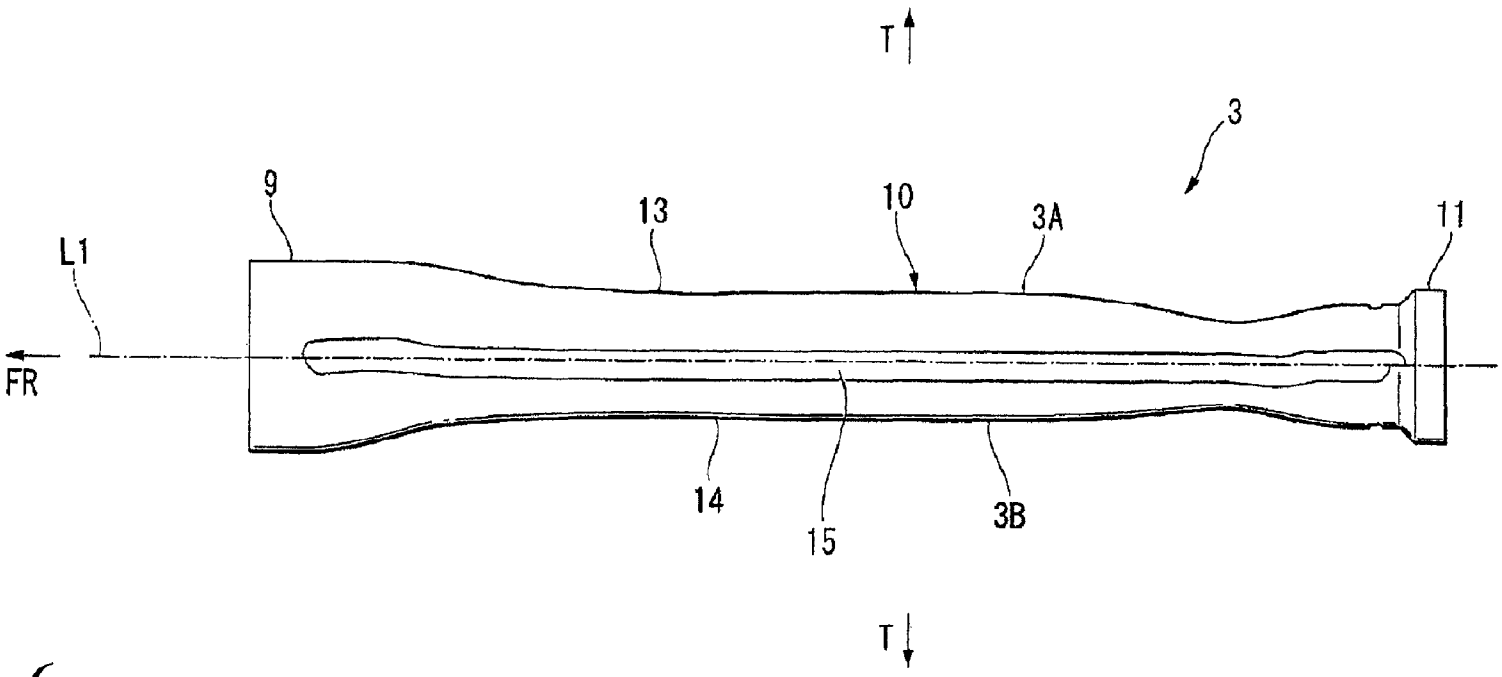
FIG. 6 is a view of the inner tube shown in FIG. 4 as viewed from sidewardly.
Figure 7:
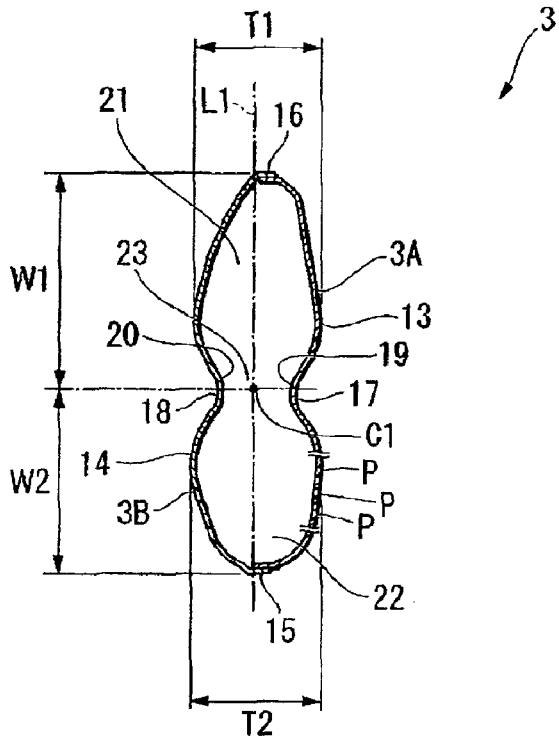
FIG. 7 is a sectional view taken along line B-B of FIG. 5.

In the inner tube body 10, the flattened face portion 13 is set on the inner tube half 3A and the flattened face portion 14 are set on the inner tube half 3B, and they are opposed to each other. FIG. 7 shows a section taken along line B-B of FIG. 5. As shown in FIG. 7, the side end portion 15 is configured by placing one end portion of the inner tube half 3A and one end portion of the inner tube half 3B on the other and welding them to each other. The side end portion 16 is configured by placing the other end portion of the inner tube half 3A and the other end portion of the inner tube half 3B on the other and welding them to each other. Also the side end portion 15 and the side end portion 16 are opposed to each other. In FIGS. 6 and 7, a parting plane L1 is between the inner tube half 3A and the inner tube half 3B.

Figure 5:
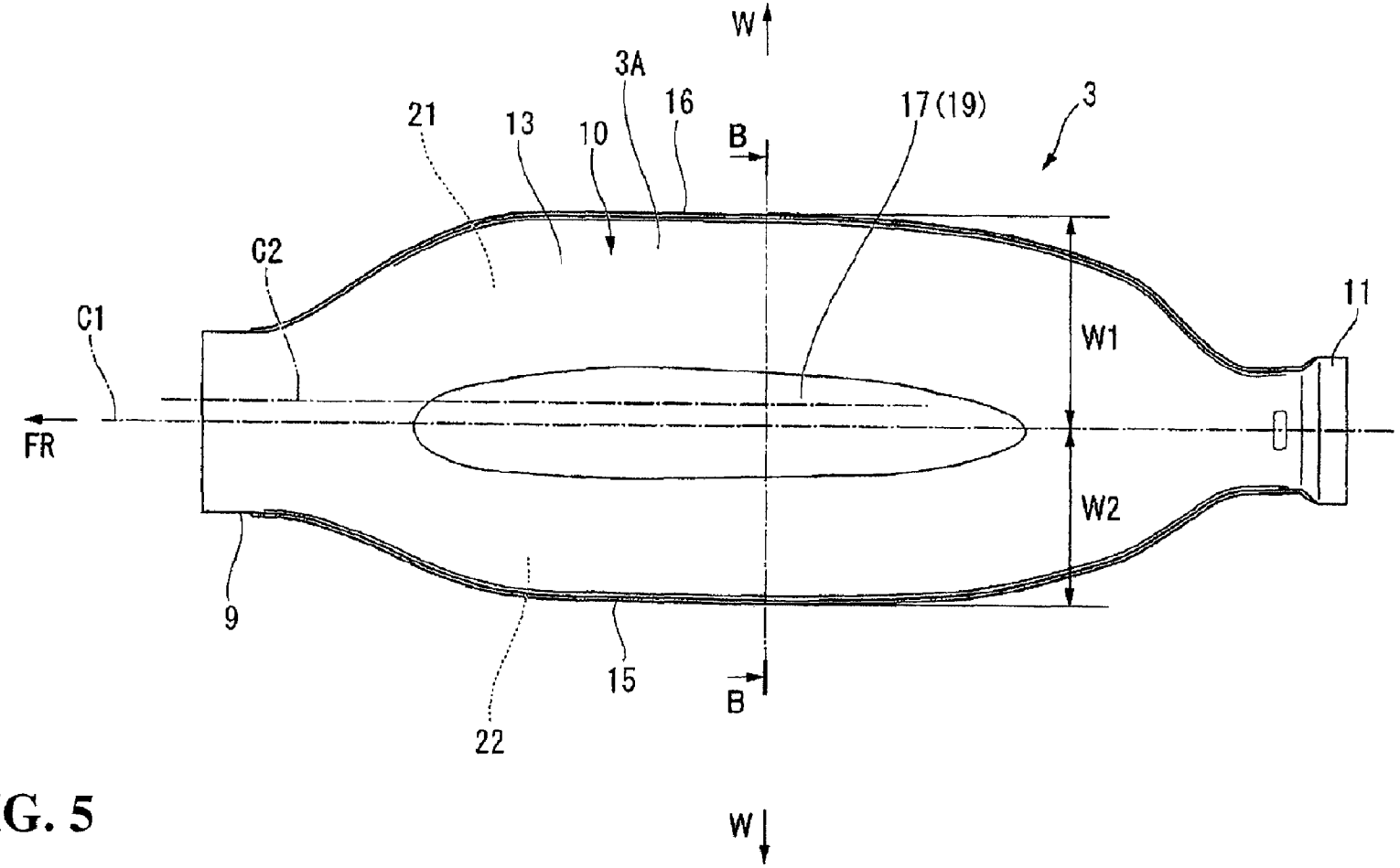
FIG. 5 is a view of the inner tube as viewed in a direction substantially perpendicular to a wide face of the inner tube.

As shown in FIG. 5, the flattened face portions 13 and 14 are formed such that they are gradually spread in the widthwise direction from the front connecting portion 9 and then the length in the widthwise direction thereof gradually decreases toward the rear connecting portion 11. Further, as shown in FIG. 5, the flattened face portions 13 and 14 are formed such that the thickness therebetween gradually decreases from the front connecting portion 9 toward the rear connecting portion 11. In other words, the inner tube body 10 is formed such that the sectional area thereof gradually decreases from a location at which the length in the widthwise direction of the flattened face portions 13 and 14 begins to gradually decrease toward the exhaust side.

The flattened face portions 13 and 14 have punching holes P formed therein. In order to clearly indicate the punching holes P, the punching holes P are shown in a partially exaggerated fashion in FIG. 7. A region A1 shown in FIG. 8 and another region A2 shown in FIG. 9 (both indicated by slanting lines) indicate regions in which the punching holes P are formed. The regions A1 and A2 extend, in the forward and backward direction, from a neighborhood from the front connecting portion 9 to a neighborhood of the rear connecting portion 11 and extends, in the widthwise direction, from a neighborhood of a location between end portions of the flattened face portions 13 and 14, that is, from a neighborhood of the side end portion 15, to a neighborhood of the side end portion 16.

The punching holes P are formed in a fixed formation density in the regions A1 and A2 while no punching hole P is formed in side end portions 15 and 16 on the opposite side portions of the flattened face portions 13 and 14. As a mode of formation of the punching holes P in the regions A1 and A2, it is a possible idea to set the hole diameter to approximately 3 mm and form the punching holes P in a fixed formation intensity such that the distance between the centers of adjacent ones of the punching holes P is approximately 4 mm. It is to be noted that this formation mode is an example, and it is a matter of course that the punching holes P may be formed in any other mode.

Figure 8:
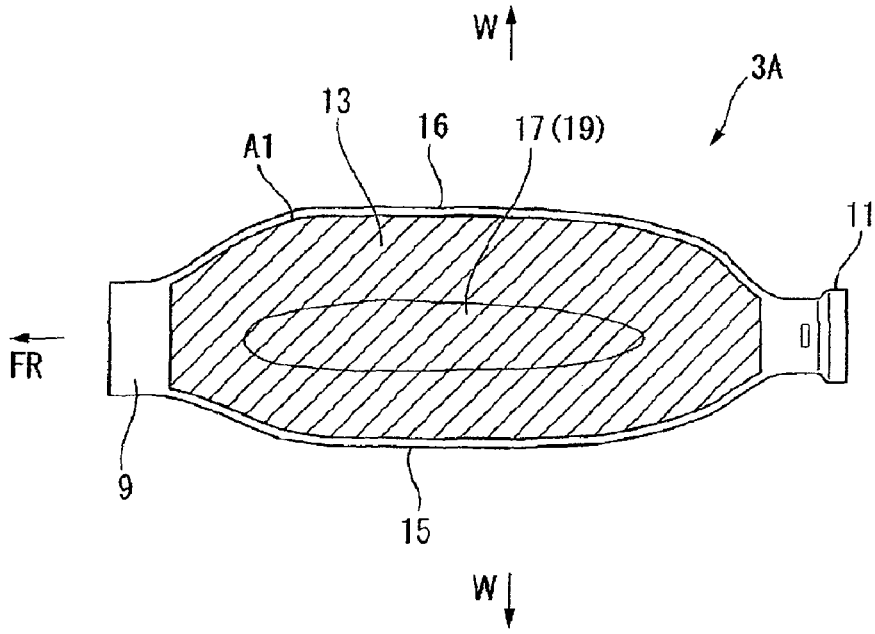
FIG. 8 is a view showing one of halves of the inner tube.
Figure 9:
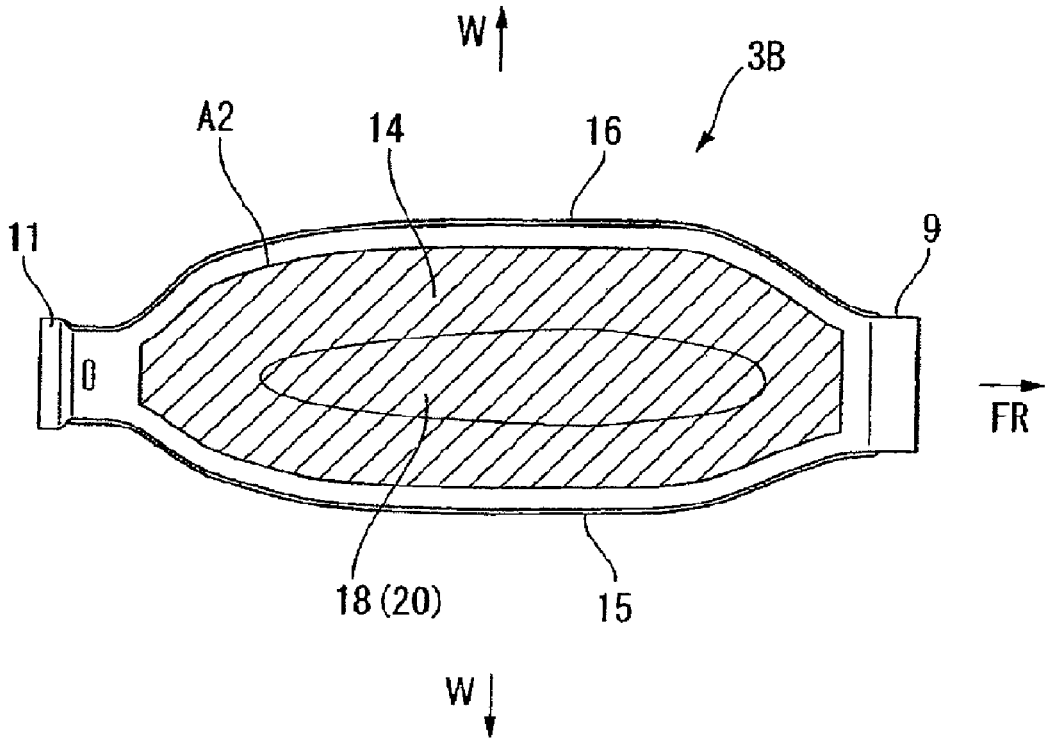
FIG. 9 is a view showing the other half of the muffler.

Referring to FIGS. 8 and 9, recesses 17 and 18 extending in the forward and backward direction, that is, along a flow of exhaust gas, are formed one by one on the flattened face portions 13 and 14, respectively. The recesses 17 and 18 are formed at locations substantially opposing to each other in the proximity of the center in the widthwise direction of the flattened face portions 13 and 14 and are formed such that they gradually sink from forwardly and then maintain a substantially fixed depth, whereafter they gradually become shallow toward the rear. Consequently, rectification portions 19 and 20 are formed on the inner face of the flattened face portions 13 and 14 such that they project inwardly and extend in the forwardly and backward direction, more specifically, along a flow of exhaust gas, as shown in FIG. 7. The rectification portions 19 and 20 are formed in an opposing relationship to each other.

The rectification portions 19 and 20 partition a single exhaust path in the inside of the inner tube body 10 to branch the exhaust path, and the inside of the inner tube body 10 is branched into paths 21 and 22 by the rectification portions 19 and 20. Consequently, in the inner tube 3, exhaust gas flowing into the inner tube body 10 flows into the paths 21 and 22 and is spread in the widthwise direction and flows. In other words, by the rectification portions 19 and 20, the inner tube body 10 has a flattened sectional shape, that is, a peanut shape wherein the path 21 provided at one end on the long side and the path 22 provided at the other end on the long side are connected to each other through a reduced diameter portion 23. It is to be noted that the reduced diameter portion 23 indicates a space between the flattened face portions 13 and 14 contracted by the recesses 17 and 18, that is, a space between the rectification portions 19 and 20.

Referring here to FIGS. 5 and 7, a length W1 is provided from a center line C1 interconnecting the front connecting portion 9 and the rear connecting portion 11 which is an exit of exhaust gas to the side end portion 16, and a length W2 is provided from the center line C1 to the side end portion 15. Further, a thickness T1 is a portion which exhibits the greatest thickness between the flattened face portions 13 and 14 on the path 21 side. A thickness T2 is a location which exhibits the greatest thickness between the flattened face portions 13 and 14 on the path 22 side. The lengths mentioned satisfy relationships of "length W1>length W2" and "thickness T1<thickness T2," that is, satisfies relationships that the width of the path 21 is smaller than the width of the path 22 and that the thickness of the path 21 is greater than the thickness of the path 22.

More particularly, the rectification portions 19 and 20 are formed in a displaced relationship to one side from the center in the widthwise direction of the flattened face portions 13 and 14 in order to make the widths of the paths 21 and 22 different from each other, and the inner tube body 10 is formed with the thickness thereof adjusted so as to make the thickness (distance) between the inner faces of the flattened face portions 13 and 14 of the paths 21 and 22 different from each other. It is to be noted that, in FIG. 5, a center line C2 is provided in the widthwise direction of the inner tube body 10. This center line C2 is displaced from the center line C1, and the rectification portions 19 and 20 (recesses 17 and 18) extend forwardly and backwardly such that the center thereof in the widthwise direction extends along the center line C1 interconnecting the centers of the front connecting portion 9 and the rear connecting portion 11. Therefore, the centers of the rectification portions 19 and 20 in the widthwise direction are displaced from the center line C2 in the widthwise direction of the inner tube body 10 such that the widths of the paths 21 and 22 are different from each other.

Such an inner tube 3 as described above is provided in the outer tube 2, and here, in FIG. 3, reference symbol L2 denotes a line interconnecting a predetermined location P1 of the inner tube body 10 and another predetermined location P2 of the inner tube 3, at which the length from the inner tube body 10 to the inner circumferential face of the outer tube 2 is in the maximum, and L3 denotes a direction substantially of a plane of the flattened face portion 13, or in other words, a longitudinal direction where the inner tube body 10 is viewed in section, and they are substantially at right angles.

More particularly, in the present embodiment, the inner tube 3 is disposed in the outer tube 2 such that the line L2 interconnecting the predetermined location of the inner tube body 10 and the predetermined location of the inner tube 3 at which the length from the inner tube body 10 to the inner circumferential face of the outer tube 2 is in the maximum and the direction (L3) substantially of the plane of the flattened face portion 13 may be substantially perpendicular to each other.

If the inner tube 3 is provided in the outer tube 2 in such a manner as described above, then a difference appears between the outer circumferential face of the inner tube body 10 and the inner circumferential face of the outer tube 2, that is, with the gap. In short, the length (gap) from the flattened face portions 13 and 14 to the inner circumferential face of the outer tube 2 becomes greater than the length (gap) from the side end portions 15 and 16 to the inner circumferential face of the outer tube 2. In other words, the length from the flattened face portions 13 and 14 to the inner circumferential face of the outer tube 2 opposing to the flattened face portions 13 and 14 becomes greater than the length from the side end portions 15 and 16 to the inner circumferential face of the outer tube 2 opposing to the side end portions 15 and 16.

Further, the sound absorbing material 4 is filled between the inner tube 3 and the outer tube 2 in such a manner so as to fill up the gap between the inner tube 3 and the outer tube 2. The sound absorbing material 4 is configured as a single sheet-type member and is provided such that it is bent at the side end portion 15 of the inner tube body 10 and then folded back on the flattened face portions 13 and 14. More particularly, the sound absorbing material 4 is provided thick on the flattened face portions 13 and 14 from which the length to the outer tube 2 is great while it is provided thin on the side end portion 15 from which the length to the inner tube 3 is small. Further, between the side end portion 16 opposite to the side end portion 15 of the inner tube 3 at which the sound absorbing material 4 is bent and the outer tube 2, a space portion S of the sound absorbing material 4 is formed. The muffler 1 is disposed such that the space portion S is directed to the inner side of the vehicle body. In the figures L4 denotes the upward and downward direction of the muffler 1. More particularly, the muffler 1 is attached to the vehicle body such that the space portion S is directed downwardly to the inner side of the vehicle.

In the muffler 1 having such a configuration as described above, exhaust gas flowing into the inner tube 3 from the exhaust pipe EX is partly blown out from the punching holes P toward the portion of the sound absorbing material 4 which is provided thick to achieve sound deadening. In short, in the present embodiment, the punching holes P are formed only at the flattened face portions 13 and 14 at which the length to the outer tube 2 is great and a great thickness of the sound absorbing material 4 can be assured, but are not formed at the side end portions 15 and 16 at which the length to the outer tube 2 is small and the thickness of the sound absorbing material 4 cannot be assured. Consequently, with the muffler 1, a sound pressure of exhaust gas can be greatly absorbed from the portion at which the sound absorbing material 4 is formed thick.

As described above, in the present embodiment, the inner tube 3 which is a tubular member is partitioned into such regions as the flattened face portions 13 and 14 which have a great width and the side end portions 15 and 16 which have a reduced thickness, and the number of those punching holes P which are formed in the flattened face portions 13 and 14 of the inner tube 3 which have a great length to the outer tube 2 is set greater than the number of those punching holes P which are formed in the side end portions 15 and 16 which have a small length to the outer tube 2 in comparison with the flattened face portions 13 and 14. More particularly, no punching hole P is formed in the side end portions 15 and 16. In other words, the sum total of the opening area of the punching holes P formed in the flattened face portions 13 and 14 of the inner tube 3 which have a great length to the outer tube 2 is set greater than the sum total of the opening area of the punching holes P formed in the side end portions 15 and 16 of the inner tube 3 which have a small length to the outer tube 2 in comparison with the flattened face portions 13 and 14. Consequently, since the sound pressure can be greatly extracted from the portion at which the length from the inner tube 3 to the outer tube 2 is great and the thickness of the sound absorbing material 4 can be assured without the necessity to change the magnitude of the outer tube 2 to assure the thickness of the sound absorbing material 4, miniaturization can be achieved together with improvement in the sound deadening effect.

The inner tube 3 is formed in a flattened shape and is disposed in the outer tube 2 such that the line direction (L2) of a straight line interconnecting the portion of the inner tube 3 which has the greatest length to the outer tube 2 and the outer tube 2 and the direction (L2) of the plane of the flattened face portion 13 may be substantially perpendicular to each other. With this configuration, the surface area of the portion in which the punching holes P are formed can be assured, and since the punching holes P are directed to the portion of the sound absorbing material 4 which has a great thickness, the sound deadening effect can be further improved.

Further, as shown in FIG. 7, the rectification portions 19 and 20 which project toward the inner side are formed on the inner face of the flattened face portions 13 and 14 of the inner tube 3 and are formed from the recesses 17 and 18 formed on the flattened face portions 13 and 14 of the inner tube 3. Consequently, since exhaust gas passing through the inner tube 3 can be dispersed in the widthwise direction in the inside of the inner tube 3, the internal pressure can be uniformized. Further, since the rectification portions 19 and 20 are formed from the recesses 17 and 18, they have an integrated shape, and the wall thickness of the inner tube 3 can be reduced thereby to achieve a reduction in the weight.

Further, the rectification portions 19 and 20 are formed one by one on the opposing inner faces of the flattened face portions 13 and 14 such that they are opposed to each other and besides are formed in a displaced relationship to one side from the center in the widthwise direction of the flattened face portions 13 and 14 such that the widths of the paths 21 and 22 partitioned by the rectification portions 19 and 20 as shown in FIG. 7 are made different from each other. With the configuration just described, the exhaust path in the inside of the inner tube 3 can be branched by the rectification portions 19 and 20 to adjust the exhaust gas flow rate to each of the paths 21 and 22. Further, the thicknesses of the flattened face portions 13 and 14 of one of the insides of the inner tube 3 partitioned by the rectification portions 19 and 20, that is, of one of the paths 21 and 22, are made different from each other so that the distance (thickness) between the opposing inner faces is different from that of the other of the paths 21 and 22. Also by this, the exhaust gas flows can be adjusted. Such a configuration as just described is effective in a case wherein one-sidedness occurs with the flow rate of exhaust gas flowing through the inner tube 3. In short, referring to FIG. 3, in the present embodiment, the exhaust pipe EX is curved immediately prior to the connection position thereof to the inner tube 3, and in such an instance, one-sidedness occurs with the flow rate of exhaust gas in the inner tube 3. The configuration described above is effective in such an instance as just described.

It is to be noted that, while, in the present embodiment, the rectification portions 19 and 20 are displaced to one side from the center in the widthwise direction of the flattened face portions 13 and 14 to make the widths of the paths 21 and 22 different from each other, the rectification portions 19 and 20 may otherwise be formed substantially at the center in the widthwise direction of the flattened face portions 13 and 14. This mode is effective where the exhaust pipe EX to be connected is connected straightforwardly to the inner tube 3 because, in such a case that the exhaust pipe EX is connected straightforwardly to the inner tube 3, the exhaust gas flow rate to the exhaust paths branched by the rectification portions 19 and 20 can be made uniform.

Further, in the present embodiment, as shown in FIG. 5, the inner tube body 10 is formed such that the sectional area thereof decreases toward the exit side of exhaust gas, that is, toward the rear connecting portion 11 thereby to gradually narrow the exhaust path. With the configuration just described, air-flow resistance can be provided, and a sound pressure is not extracted immediately to the exit side but is extracted to the sound deadening material side. Therefore, the sound deadening effect can be further increased.

Further, the inner tube 3 is configured in a two-piece structure formed by fixing the inner cylinder halves 3A and 3B having a parting plane at edge portions of the flattened face portions 13 and 14, that is, at the side end portions 15 and 16, such that the punching holes P are not formed on the side end portions 15 and 16 side of the flattened face portions 13 and 14. With the configuration just described, the inner tube 3 can be produced readily, wherein a structure for extracting a sound pressure can be formed at the portion of the sound absorbing material which has a increased thickness.

Further, the sound absorbing material 4 is formed as a single sheet-like member, and the sound absorbing material 4 is formed such that it is bent at the side end portion 15, which is one end portion of the flattened face portions 13 and 14, and then folded on the flattened face portions 13 and 14. With the configuration just described, the inner tube 3 can be covered efficiently with the sound absorbing material 4 such that the thickness of the flattened face portions 13 and 14 at which the sound pressure is extracted increases.

It is to be noted that, while, in the present embodiment, the sectional shape of the outer tube 2 is a substantially pentagonal shape which is rounded at angular portions thereof, also where the sectional shape of the outer tube 2 is, for example, a circular shape, a difference in the length between the outer circumferential face of the inner tube body 10 and the inner circumferential shape of the outer tube 2 appears, and the shape of the outer tube 2 may be different from that in the present embodiment. For example, the sectional shape of the outer tube 2 may be a circular shape. Further, while, in the present embodiment described, the inner tube 3 has a two-piece structure, it may otherwise be formed as a unitary member.

Further, the shape of the inner tube body 10 of the inner tube 3 need not be formed as a flattened shape. In particular, for example, even where the outer tube 2 has a flattened shape and the sectional shape of the inner tube 3 is a circular shape, a difference in length appears between the inner tube 3 and the outer tube 2. In such an instance, if the number of punching holes P at a portion of the inner tube 3 which has a great length to the outer tube 2 is made greater than the number of punching holes P of the side end portions 15 and 16 which have a small length to the outer tube 2 in comparison with the portion having the great length, that is, if the sum total of the opening area of the punching holes P formed in the flattened face portions 13 and 14 of the inner tube 3 which have a great length to the outer tube 2 is set greater than the sum total of the opening area of the punching holes P formed in the side end portions 15 and 16 of the inner tube 3 which have a small length to the outer tube 2 in comparison with the flattened face portions 13 and 14, then the sound pressure can be extracted much from the portion at which the length from the inner tube 3 to the outer tube 2 is great and the thickness of the sound absorbing material 4 can be assured, miniaturization can be achieved together with improvement of the sound deadening effect. It is to be noted that, in the present invention, the term flattened is used to signify that a sectional structure where a tubular member which configures the inner tube 3 is viewed in cross section is formed from major side portions opposing to each other and minor side portions opposing to each other and coupling the opposite end portions of the major side portions, and is presupposed to include a case in which the major side portions and the minor side portions do not exhibit a strictly parallel state as in the present embodiment.

Further, while the present embodiment described has a mode wherein the punching holes P are formed in the flattened face portions 13 and 14 while no punching hole P is formed in the side end portions 15 and 16, the punching holes P may be formed in the side end portions 15 and 16. In this instance, the number of punching holes P formed in the side end portions 15 and 16 should be smaller than that in the flattened face portions 13 and 14. Further, while the present embodiment described is an example wherein the punching holes P are formed, for example, in a fixed formation density in the region A1 and A2 of the flattened face portions 13 and 14, the punching holes P may be formed in another mode wherein, for example, the formation density thereof gradually decreases from the center in the widthwise direction toward the side end portions 15 and 16 in the flattened face portions 13 and 14. Furthermore, while, in the present embodiment, the punching holes P have a fixed hole diameter, they may be formed in such a mode that the opening area of the hole diameter is varied such that a sound pressure may be extracted by a greater amount through the thick portion of the sound absorbing material 4. In particular, the punching holes P may be formed in such a mode that the hole diameter of the punching holes P at the portion of the inner tube 3 which has a great length to the outer tube 2 is greater than the hole diameter of the punching holes P in the side end portions 15 and 16 which have a small length to the outer tube 2 in comparison with that at the portion having the great length. That is, as described above, it may be possible if the opening area of the diameter of the punching holes P of the inner tube 3 which have a great length to the outer tube 2 is set greater than the opening area of the diameter of the punching holes P formed in the side end portions 15 and 16 of the inner tube 3 which have a small length to the outer tube 2 in comparison with the portion having the great length.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A muffler comprising:

An outer tube defining an outer wall,

An inner tube provided in said outer tube and

A sound absorbing material filled between said outer tube and said inner tube, and which is attached to an exhaust pipe for exhausting exhaust gas from an engine, The inner tube comprising:

A flattened face portion on opposite surfaces thereof causing the inner tube to have a flattened shape, a pair of main flow paths extending in a longitudinal direction on each lateral side of the inner tube side, A recess formed in each of said flattened face portions between the pair of main flow paths, the recess causing portions of each of the flattened face portions to project inwardly toward each other, and A number of punching holes formed in each of the flattened face portions of said inner tube being greater than the number of punching holes formed at edge portion sides of the flattened face portions of said inner tube.

2. The muffler according to claim 1, wherein said inner tube is disposed in said outer tube such that a linear direction of a straight line(L2) which interconnects the portion which has the large surface area facing said outer tube and a direction (L3) of a plane of said flattened face portion are substantially perpendicular to each other.

3. The muffler according to claim 2 wherein a rectification portion is formed on an inner face of each said flattened face portions of said inner tube in such a manner as to project inwardly toward each other.

4. The muffler according to claim 3 wherein the recesses are arranged on opposite sides of a common center line (c1) of front and rear connection portions of the inner tube, and extending the longitudinal direction of the inner tube.

5. The muffler according to claim 3, wherein said rectification portions are formed on an opposing inner face of each said flattened face portions such that the rectification portions oppose each other.

6. The muffler according to claim 4 wherein said rectification portions are formed on an opposing inner face of said flattened face portions such that the rectification portions oppose each other.

7. The muffler according to claim 3 wherein the inner tube has an inner tube body which is arranged in a non-symmetrical manner around a common centerline (C1) of front and rear connection portions of the inner tube.

8. The muffler according to claim 4, wherein the inner tube has an inner tube body which is arranged in a non-symmetrical manner around the common center line (C1).

9. The muffler according to claim 5, wherein a distance between the rectification portions on the opposing inner faces of the flattened face portions is different from distances between other portions of the inner faces of the opposing flattened face portions.

10. The muffler according to claim 7, wherein a distance between the rectification portions on the opposing inner faces of the flattened face portions is different from distances between other portions of the inner faces of the opposing flattened face portions.

11. The muffler according to claim 1, wherein said inner tube includes a sectional area which decreases toward an exit side of the exhaust gas.

12. The muffler according to claim 2, wherein said inner tube includes a sectional area which decreases toward an exit side of the exhaust gas.

13. The muffler according to claim 3, wherein said inner tube includes a sectional area which decreases toward an exit side of the exhaust gas.

14. The muffler according to claim 4, wherein said inner tube includes a sectional area which decreases toward an exit side of the exhaust gas.

15. The muffler according to claim 1 wherein said inner tube has a two-piece structure formed by fixing two members having a parting plane (L1) at the edge portion sides of the flattened face portions.

16. The muffler according to claim 2 wherein said inner tube has a two-piece structure formed by fixing two or more members having a parting plane (L1) at the edge portion sides of the flattened face portions, and said punching holes are not formed on the edge portion sides of the flattened face portions.

17. The muffler according to claim 3, wherein said inner tube has a two-piece structure formed by fixing two or more members having a parting plane (L1) at the edge portion sides of the flattened face portions, and said punching holes are not formed on the edge portion sides of the flattened face portions.

18. The muffler according to claim 2 wherein said sound absorbing material is a single sheet-like member that is bent adjacent to said flattened face portions.

19. The muffler according to claim 3 wherein said sound absorbing material is a single sheet-like member that is bent adjacent to said flattened face portions.

20. The muffler according to claim 3 wherein said inner tube is formed in a peanut shape.

* * * * *